US012466633B2

(12) United States Patent
Cychner et al.

(10) Patent No.: US 12,466,633 B2
(45) Date of Patent: Nov. 11, 2025

(54) LABEL CONTAINER AND DISPENSER

(71) Applicant: REMINGTON RAND INC., Beloit, WI (US)

(72) Inventors: Bridget Cychner, McHenry, IL (US); Cristin Guenther, Woodstock, IL (US); Madelyn Guenther, Woodstock, IL (US)

( * ) Notice: Subject to any disclaimer, the term of this patent is extended or adjusted under 35 U.S.C. 154(b) by 0 days.

(21) Appl. No.: 18/139,711

(22) Filed: Apr. 26, 2023

(65) Prior Publication Data

US 2024/0359901 A1 Oct. 31, 2024

(51) Int. Cl.
*B65D 83/08* (2006.01)
*B65D 17/00* (2006.01)
*B65D 17/28* (2006.01)

(52) U.S. Cl.
CPC ..... *B65D 83/0894* (2013.01); *B65D 17/04* (2013.01); *B65D 17/4012* (2018.01); *B65D 2583/082* (2013.01)

(58) Field of Classification Search
CPC ..... B65D 83/0894; B65D 17/4012; B65D 17/04; B65D 2583/082
USPC ..... 206/494
See application file for complete search history.

(56) References Cited

U.S. PATENT DOCUMENTS

| | | | | |
|---|---|---|---|---|
| 5,497,701 | A * | 3/1996 | Uland | B65C 11/0289 101/288 |
| 9,308,149 | B1 * | 4/2016 | Niskey, Jr. | A61J 1/1425 |
| 10,723,542 | B1 * | 7/2020 | Newman | B65D 83/0805 |
| 2019/0369931 | A1 * | 12/2019 | Katayama | B65D 5/6608 |
| 2021/0292043 | A1 * | 9/2021 | Medrano | B65D 5/6602 |
| 2023/0242302 | A1 * | 8/2023 | Livingston | B65D 5/566 229/122.32 |

* cited by examiner

*Primary Examiner* — Jacob K Ackun
(74) *Attorney, Agent, or Firm* — Pauley Erickson & Swanson

(57) ABSTRACT

An apparatus and method for holding and dispensing labels. A container provides for both packaging and dispensing continuous feed labels. A bottom portion of the container includes a detachable portion for improved label feed. At least one of the bottom portion or a lid includes cutout to support a roll for a label roll. The detachable portion improves label feeding from the container, particularly near the end of the label supply. The bottom portion of the container can also be stacked on the lid to raise the labels to a better feed geometry.

20 Claims, 5 Drawing Sheets

LABEL CONTAINER AND DISPENSER

BACKGROUND OF THE INVENTION

This invention relates generally to self-adhesive labels, and, more particularly, packaging and dispensing of self-adhesive labels, such as for feeding to a printer.

Continuous feed labels are used in both desktop and industrial printers. Continuous feed labels are typically embodied as stacked fanfold labels, folded on the perforations between adjacent labels, or a roll of labels, also connected at perforations to adjacent labels.

Larger print machines often have a structure to hold or secure the stack or roll of continuous feed labels. However, smaller or pocket-sized printers are being sold that do not have such integrated label storage. Typically a user removes the labels from the packaging and simply places the fanfold stack behind the printer on the desk/table surface. This has disadvantages to the mobility that such small printers are intended to provide. Thus there is a continuing need for improvements for label storage and dispensing, particularly for small and/or portable printers.

SUMMARY OF THE INVENTION

A general object of the invention is to provide an improved packaging for labels that can also be used to improve continuous feed dispensing of the labels.

The general object of the invention can be attained, at least in part, through an apparatus for holding and dispensing labels, which includes a bottom portion including a bottom panel, four bottom side walls, and an open top. The bottom panel and four bottom side walls enclose a container space configured to hold a plurality of labels, such as a stack of fanfold labels or a roll of labels. The apparatus includes a lid configured to fit over the bottom portion and cover the open top and enclose the container space. The lid includes a top panel, four lid side walls, and an open bottom configured to receive the bottom portion.

In embodiments of the invention, a first side wall of the four bottom side walls includes a detachable section configured to open a feed opening and allow a feed of the plurality of labels to a printer through the feed opening. The detachable section is desirably formed between two tearable lines of separation within or at opposing edges of the first bottom side wall. The term "tearable lines of separation," also referred to as simply "tearable lines," "lines of separation" or "separation lines," relate to physical or structural lines that can be torn to separate a removable portion or section from the remaining portion or section of the corresponding structure. The tearable line(s) can be or include a full die cut through a material, a partial thickness kiss cut, and/or a perforated cut in a surface or structure. Desirably, for ease of use, each of the two tearable lines comprises a cut through the bottom portion. A breakable material bridge between each of the tearable lines and the open top can be used to keep the detachable section from opening before consumer use. The two tearable lines desirably extend from a fold line extending across the first bottom side wall toward the open top.

In additional or alternative embodiments of the invention, each of a second bottom side wall and a third bottom side wall of the four bottom side walls, such as extending perpendicular to the first bottom side wall, includes rounded cutout adapted to receive a label roll holder. The second bottom side wall is connected to the bottom panel on an opposite side of the container space from the third bottom side wall. The rounded cutout can be a semi-circle cutout extending from, within, or otherwise formed at or by a top edge of the side walls. A tubular label roll holder configured to extend through the roll of labels sets and rotates within the cutouts, with each of opposing holder ends set in one of the opposing rounded cutouts.

In embodiments, each of opposing lid side walls, extending perpendicular from the top portion, alternatively or additionally includes the rounded cutouts adapted to receive the label roll holder.

In additional or alternative embodiments of the invention, the apparatus includes a securing structure to secure the bottom portion stacked on the lid (with open bottom downward of the surface), to raise the label dispensing. In some embodiments, a raisable tab is defined within the bottom panel, and an open or openable slot cut within the top panel of the lid. The raisable tab is sized to fit within the slot to secure the bottom portion in a stacked position upon the lid. The raisable tab can be cut along a portion of the periphery, and have a fold line connecting ends of the cut, preferably at an edge intersection of the bottom panel and one of the four bottom side walls.

The invention further includes an apparatus for holding and dispensing labels, which includes a bottom portion including a bottom panel, four bottom side walls, and an open top. The bottom panel and four bottom side walls enclose a container space configured to hold a plurality of labels, such as where the plurality of labels are embodied as a stack of fanfold labels or a roll of labels. A lid is configured to fit over the bottom section and cover the open top. The lid includes a top panel, four lid side walls, and an open bottom configured to receive the bottom portion. A first side wall of the four bottom side walls includes a fold line extending parallel to the bottom panel and two cuts extending from the fold line towards the open top to form a detachable section. The detachable section is foldable about the fold line to open a feed opening in the first side wall and allow a feed of the plurality of labels to a printer through the feed opening. Each of the cuts is desirably at a corner intersection of the first bottom side wall and an adjacent bottom side wall. Again, a breakable material bridge can be used between each upper end of the cuts and the open top to keep the detachable section flap from opening before use. The apparatus can additionally include the tubular roll holder and cutouts and/or the tab(s) and slot(s) discussed above.

The invention further includes a method of using the apparatus including steps of: removing the lid from the bottom portion to expose the plurality of labels; folding the detachable section at an angle to a remaining portion of the first side wall to expose the feed opening; and feeding the labels through the feed opening to the printer. The method of some embodiments can further include steps of: placing a label roll holder through the roll of labels; setting ends of the label roll holder that extend past opposing sides of the roll of labels within the rounded cutouts of the second and third bottom side walls; and feeding the labels of the roll through the feed opening to the printer. The method of some embodiments can further include steps of: raising the raisable tabs outward from the bottom panel; placing the lid on a surface with the open bottom on the surface; aligning the raised tab with the open slot of the top panel; stacking the bottom portion on the lid with the raised tab within the open slot; and feeding the labels through the feed opening to the printer.

Other objects and advantages will be apparent to those skilled in the art from the following detailed description taken in conjunction with the appended claims and drawings.

DETAILED DESCRIPTION OF THE INVENTION

The present invention provides an apparatus for holding and dispensing labels. The apparatus is preferably embodied as a packaging container for use in retail sales (e.g., storing, transporting, and displaying) of the labels within, however the apparatus can also be sold separately from the labels and/or further used with additional label refills. The apparatus is illustrated as a box container having solid walls, preferably made of corrugated cardboard, but can be implemented in other forms, such as a partial container (e.g., not having solid walls or having a frame structure) and/or formed of plastic.

Figure 1:
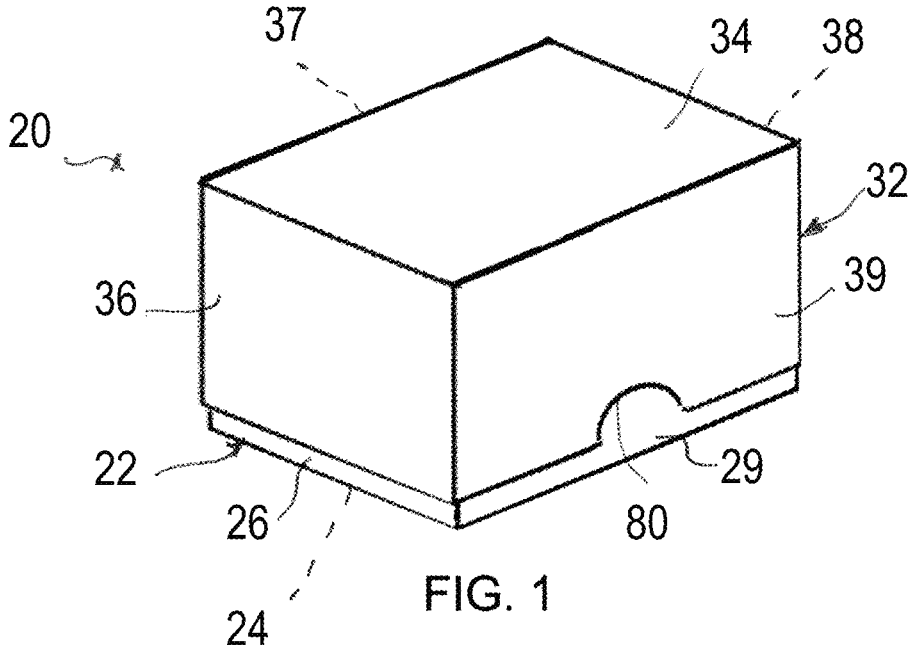
FIG. 1 is a perspective view of a label container, according to one embodiment of this invention.
Figure 2:
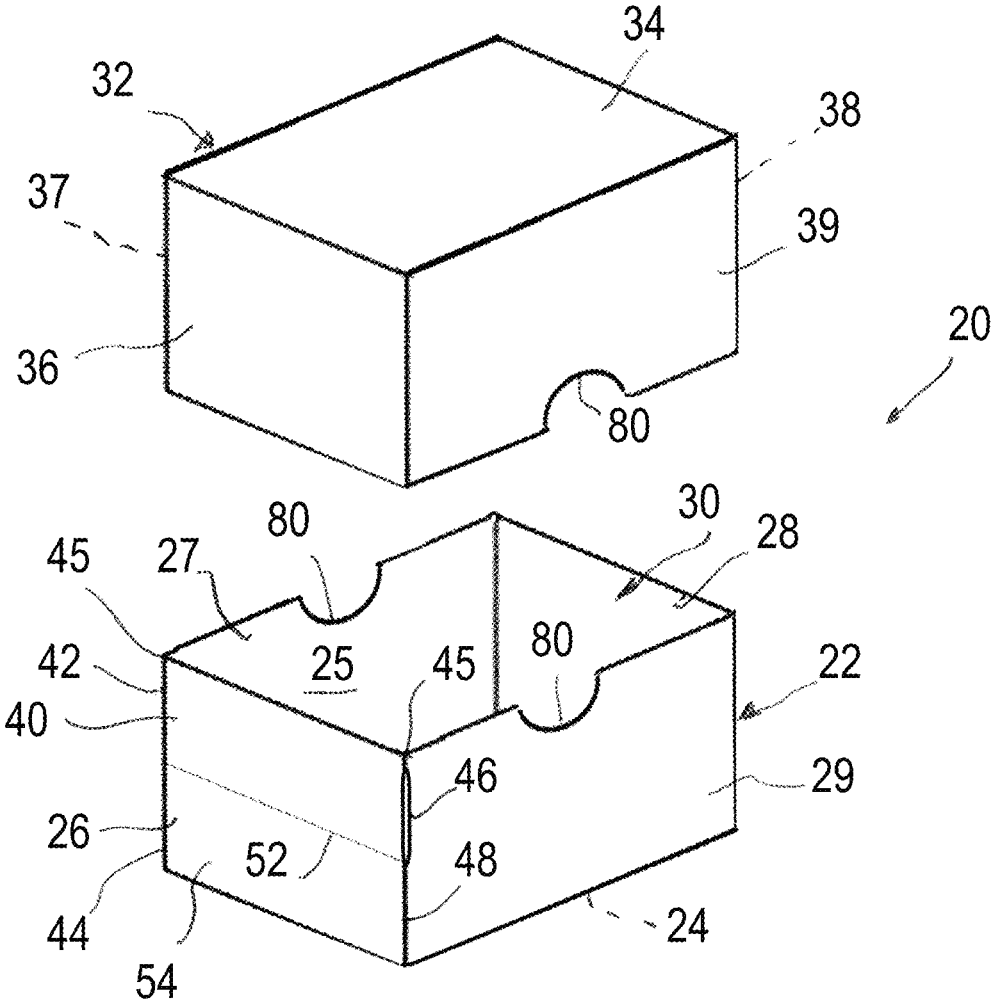
FIG. 2 is an exploded or open configuration of the container according to FIG. 1.
Figure 4:
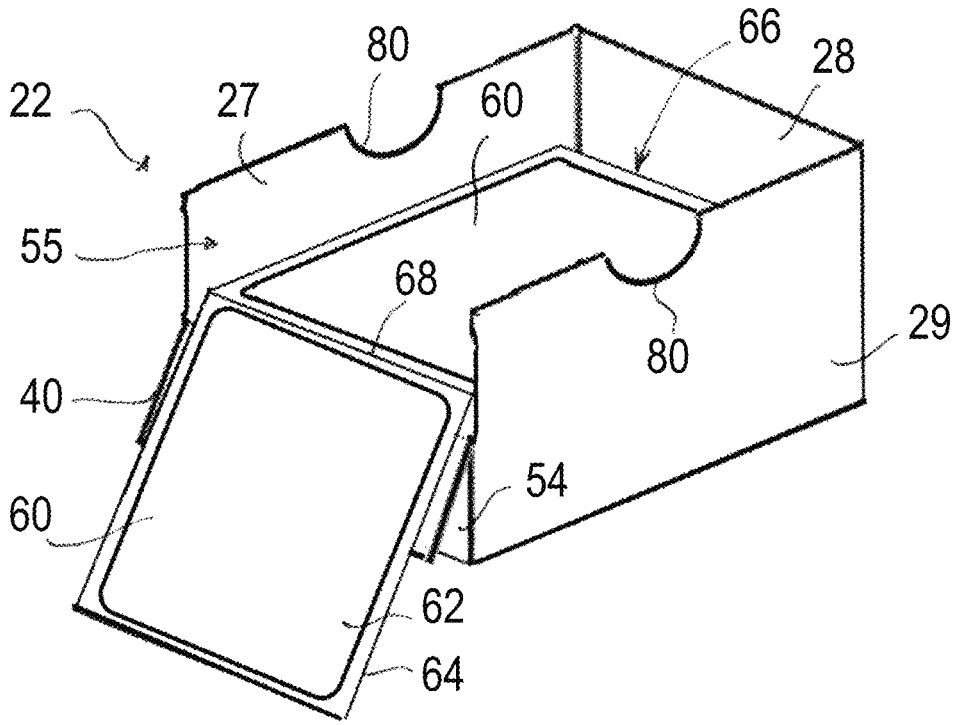
FIG. 4 shows a use configuration of the container according to FIG. 3, with labels.
Figure 7:
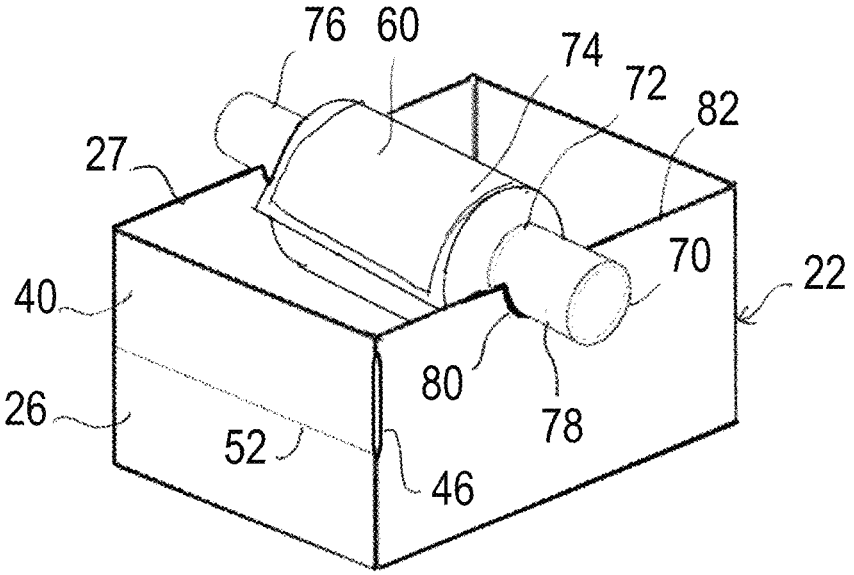
FIG. 7 shows a perspective view of the roll attachment of FIG. 5, with labels, in combination with a label container according to FIG. 1.

FIGS. 1 and 2 show a container, embodied as box 20, for packaging or holding a supply of continuous feed labels, such as the fanfolded labels shown in FIG. 4 or the roll of labels shown in FIG. 7. FIG. 1 shows the box 20 in the closed position, for retail sale, storage, transport, etc. The box 20 includes a bottom portion 22 including a bottom panel 24, four bottom side walls 26, 27, 28, 29, and an open top 25. The bottom panel 24 and four bottom side walls 26, 27, 28, 29 enclose a container space 30 configured to hold a plurality of labels (see FIG. 4). The box 20 further includes a lid 32 configured to fit over the bottom portion 22 and cover the open top 25. The lid 32 includes a top panel 34, four lid side walls 36, 37, 38, 39, and an open bottom 35 configured to receive the bottom portion to close the box 20 as shown in FIG. 1.

In embodiments of this invention, one or both sections of the container includes a detachable section that promotes the continuous feed of the labels to a printer. As shown in FIG. 2, bottom side wall 26 includes a detachable section 40. The detachable section 40 is formed between a first tearable line 42 cut at the edge intersection 44 of bottom side wall 26 and bottom side wall 27, and a second tearable line 46 cut at the edge intersection 48 of bottom side wall 26 and bottom side wall 29. The tearable line is illustrated as a die cut completely through the side wall material, but can alternatively be any suitable tearable line that can be broken by a user. As illustrated, the die cut tearable lines 42, 46 are each supported at a top edge of the side walls by a material bridge 45 between the cut ends and the upper sidewall edges. The material bridge 45 is a short uncut portion that holds the detachable section 40 in place until broken by a consumer user.

Figure 3:
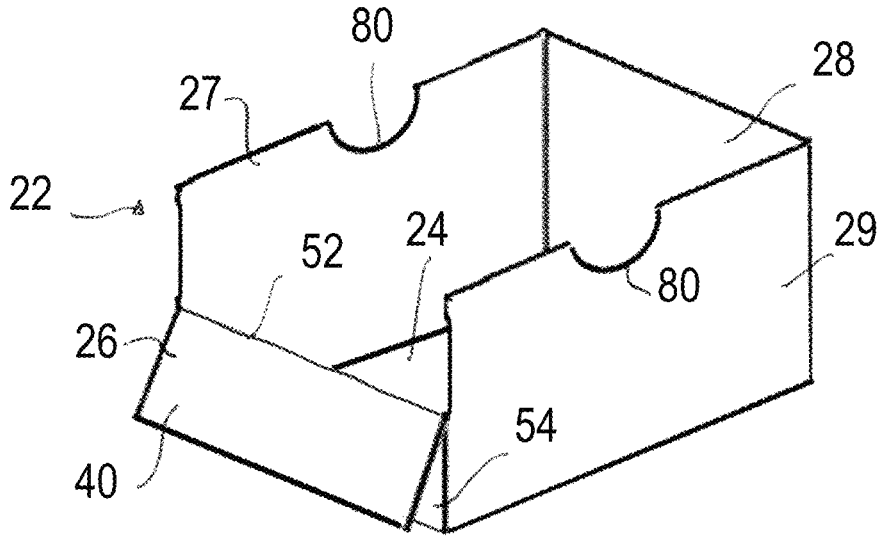
FIG. 3 shows a use configuration of the container according to FIG. 1, without labels.

The detachable section 40 can be fully removeable or simply folded outward and/or downward. In the embodiment of FIG. 2, a fold line 52 extends across the bottom side wall 26, extending from edge 44 to edge 48. The fold line 52 can be physically real (e.g., scored or perforated) or imaginary (e.g., marked by ink or simply formed during folding). The ends of the fold line 52 intersect the bottom end of each of tearable lines 44 and 46. As shown in FIG. 3, upon breaking the material bridges 45, the detachable section 40 can be folded along fold line 52 outward and downward from a remaining portion 54 of the bottom side wall 26. As shown in FIG. 4, the folded detachable section 40 opens a feed opening 55 that promotes a feed of the labels 60 to a printer (not shown). The lower side wall 54 height after folding, without limitation, improves label feed, particularly as the label stack 62 grows smaller during use.

Various sizes, shapes, and configurations of the detachable section, tearable lines, and fold line are available, depending on need. For example, the detachable section can be fully removable, the tearable lines can be cut further in from the adjacent side walls, and/or two fold lines and multi-segment cuts can be used for a multi-stage detachable section.

FIG. 4 shows a fanfolded stack 66 of continuous feed labels 60. The labels 60 are formed of a face sheet 62 and a back sheet 64. The back sheet 64 is desirably about the same size as the face sheet 62, but may be slightly larger or smaller than the face sheet 62. The surface of the face sheet 62 that is disposed toward the back sheet 64 includes an adhesive material coating. The adhesive coating can include any adhesive material known and available to those skilled in the art for forming pressure sensitive, or self-adhesive labels. The back sheet 64 is desirably formed of a material to which the adhesive coating adheres significantly less than to the face sheet 62, such as is known for forming pressure sensitive, or self-adhesive labels. Sections of the back sheet 64 under each label 60 are connected by perforated lines 68 to form one continuous line of labels folded about the perforated lines into stack 66. The stack 66 is folded label-to-label so that the label 60 faces the desired upward direction for the print process.

The face sheet 62 is of any suitable shape, and generally any suitable size that can be accepted by and fed through a printer, such as a laser printer, a thermal printer, or an ink jet printer. Common sizes of typing paper generally fed through printers are 8.5 inches by 5.5 inches, 8.5 inches by 11 inches, 8.263 inches by 11.688 inches (A4 size), and 8.5 inches by 14 inches. Common sizes for shipping or packaging labels are generally smaller, such as 4 inches by 6 inches. The face sheet 62 is preferably, but not necessarily, constructed of any suitable paper, paper composite, non-metal and/or metal material that can be used as a label. The adhesive coating covered by the back sheet is applied to the face sheet 62 in any suitable manner known to those skilled in the art. The face sheet 62 desirably has a printable surface on a side opposite the adhesive coating. The face sheet 62 and the printable surface can be any of a variety of face materials used to make pressure sensitive, or self-adhesive labels. The phrase "printable surface" relates to a surface of any type of matter upon which a person or machine can draw, print, color, paint, photocopy, write, emboss, or make any other type of mark or graphic. Laser printers, ink jet printers, impact printers, thermal transfer printers, direct thermal printers, typewriters, or any other suitable graphic printing devices are preferred but not necessary for use with printable surfaces according to this invention. Such face materials may include, but are not limited to: smudgeproof stock, litho stock, cast coated stock, tag stock, fluorescent stock, foils, computer printable polyester, vinyl, satin cloth, Tyvek™ material, flexible plastic, book papers, photo quality papers and/or photo quality film. Furthermore, various portions of the face materials can be different colors, thereby resulting in different colored parts.

Figure 5:
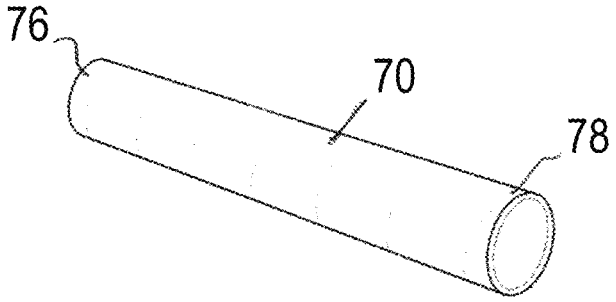
FIG. 5 is a perspective view of a roll attachment, according to one embodiment of this invention.

In embodiments of this invention the container is additionally or alternatively capable of dispensing a continuous label feed in the form of a roll of labels, such as a roll of 4×6 inch shipping labels. FIG. 5 shows a tubular or cylindrically shaped roll holder 70 that is sized to fit within the center support roll 72 of a roll of labels 74, as shown in FIG. 7. The roll holder 70 is sized to have ends 76, 78 that extend out past the sides of the roll of labels 74. The roll holder 70 can also be formed of cardboard or any suitable material. In embodiments, one or more roll holders can be included within the closed container (see FIG. 1) with the labels, whether stacked or rolled.

Figure 6:
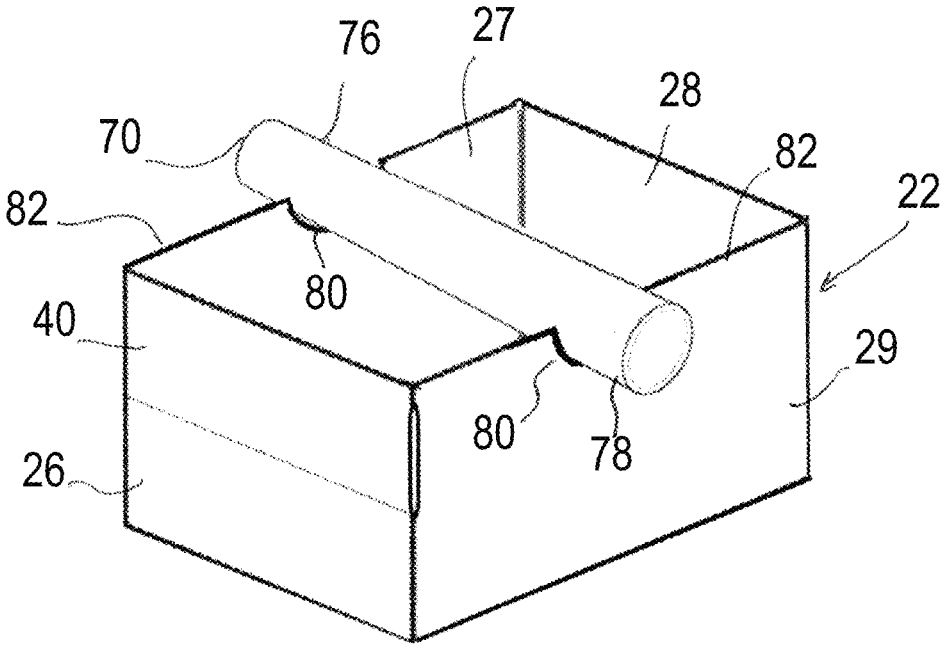
FIG. 6 shows a perspective view of the roll attachment of FIG. 5, without labels, in combination with a label container according to FIG. 1.

As shown in FIGS. 1-4 and 6-10, at least one, and desirably both, of the bottom portion and lid of the container includes a structure to receive the ends of the roll holder. As illustrated, the structure is a rounded cutout in the upper or lower edge of opposing side walls. Referring to FIGS. 2, 3, and 6, the opposing bottom side walls 27 and 29, which extend perpendicular to the bottom side wall 26, includes a semi-circular cutout 80 extending from or within a top edge 82. As shown in FIG. 6, the ends 76, 78 fit into the cutouts, respectively, to support the roll holder 70 and the accompanying label roll 74 as shown in FIG. 7. FIGS. 6 and 7 show the detachable section 40 in an unopened position, and the detachable section 40 can be removed as needed. The lid 32 can alternatively or additionally include cutouts 80 as shown, depending on need.

Various sizes, shapes, materials, and configurations are available for the roll depending on need and the intended label roll. As an example, a full circle cutout can be disposed in the opposing sidewall, and the roll slid therethrough. The roll can also include attachment structures at or for the opposing ends configured to attach the side wall upper edges.

Figure 8:
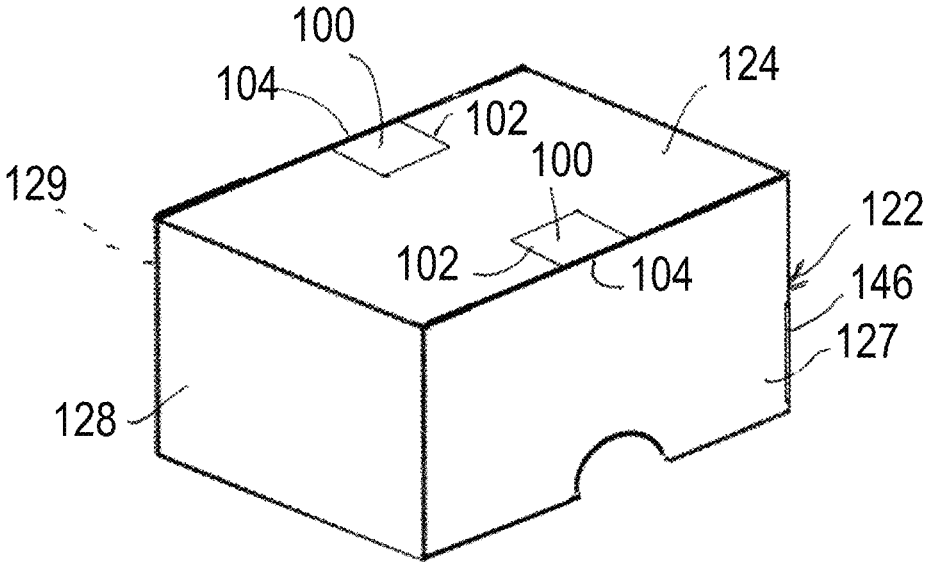
FIGS. 8-10 are perspective views of a label container according to one embodiment of this invention.
Figure 9:
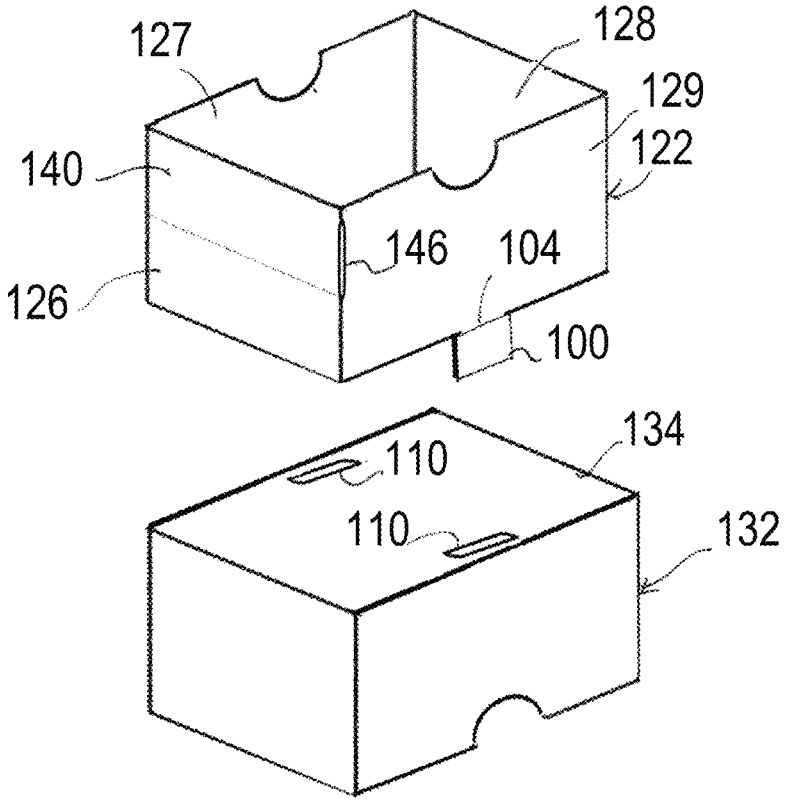
Figure 10:
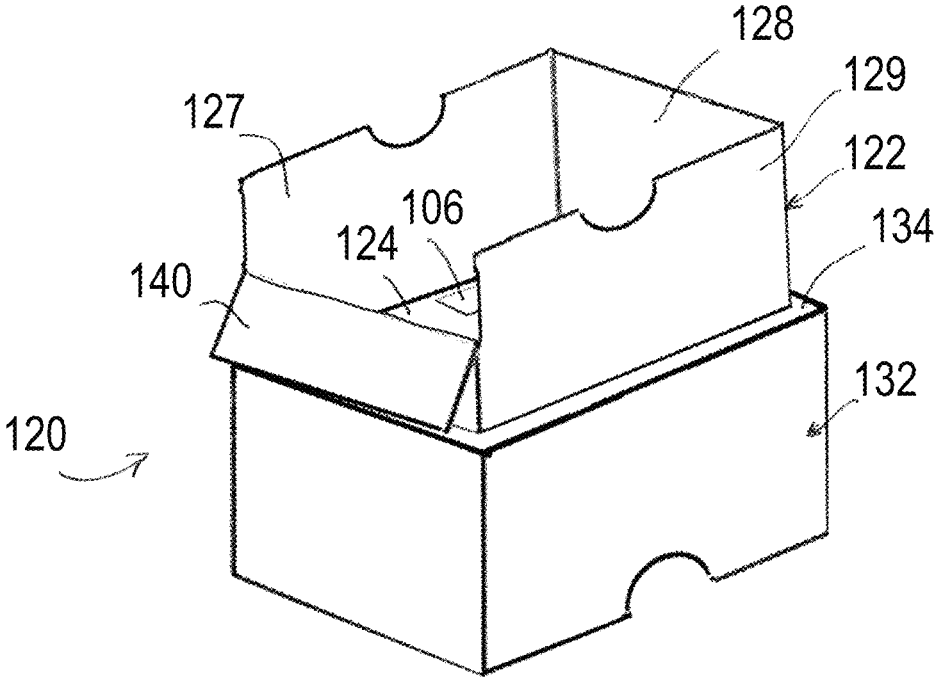

FIGS. 8-10 show an additional embodiment of this invention, further including a support structure to allow for secure stacking of the container sections, once opened, such as to raise the label supply relative the printer. FIG. 8 shows a bottom panel 124 of a container bottom section 122 including two raisable tabs 100 cut therein. The tabs 100 are cut around a partial periphery, e.g., on three sides, with a tearable line 102, with an additional portion, e.g., a fourth side, having a fold line 104. The fold line 104 desirably aligns with, and is formed by, the folded intersection of the bottom panel 124 and the side walls 127 and 129.

FIG. 9 shows a tab 100 in a raised position, raised relative to the bottom panel 124. When raised, each tab 100 leaves an opening 106. FIG. 9 also shows a corresponding receiving structure within the lid 132. The top panel 134 includes a corresponding pair of open or openable slots 110 cut therein. The slots 110 can be opened at manufacturing (due to small size), or a shape cut in the top panel 134 to allow the consumer user to punch out the material and open the slots 110. As shown in FIGS. 9 and 10, each raised tab 100 is sized to fit within a corresponding slot 110 to secure the bottom portion 122 in a stacked position upon the lid 132. FIG. 10 further shows the detachable section 140, defined by cuts 146, in the open position. The stacked position of FIG. 10 can provide height improved label feed, such as to top-feed printers.

As will be appreciated, the amount, size, shape, placement, and configuration of the tabs and corresponding slots can vary depending on need. For example, the tabs/slots can be placed further within the bottom panel, two tabs/slots can be placed on opposing sides, and/or alternatively or additionally tabs/slots be placed along the side walls 126 and/or 128.

Thus, the invention provides a container for storing and shipping labels, as well as forming an improved dispenser for those labels. The invention is useable with either fanfolded labels or rolled labels, or both. The invention further provides for raising the label supply for improved top-feed printers.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. An apparatus for holding and dispensing labels, the apparatus comprising:

a bottom portion including a bottom panel, four bottom side walls, and an open top, wherein the bottom panel and four bottom side walls enclose a container space configured to hold a plurality of labels, wherein the plurality of labels are embodied as a stack of fanfold labels or a roll of labels;

a lid configured to fit over the bottom portion and cover the open top, the lid including a top panel, four lid side walls, and an open bottom configured to receive the bottom portion;

wherein a first side wall of the four bottom side walls includes a detachable section configured to open a feed opening and allow a feed of the plurality of labels to a printer through the feed opening.

2. The apparatus of claim 1, wherein the detachable section is formed between two tearable lines within or at opposing edges of the first bottom side wall.

3. The apparatus of claim 2, wherein each of the two tearable lines comprises a cut through the bottom portion.

4. The apparatus of claim 3, wherein each of the two tearable lines extends from a fold line extending across the first bottom side wall towards the open top.

5. The apparatus of claim 4, further comprising a breakable material bridge between each of the tearable lines and the open top.

6. The apparatus of claim 1, wherein each of a second bottom side wall of the four bottom side walls and a third bottom side wall of the four bottom side walls extends perpendicular to the first bottom side wall, the second bottom side wall connected to the bottom panel on an opposite side of the container space from the third bottom side wall, and each of the second and third bottom side walls including a rounded cutout adapted to receive a label roll holder.

7. The apparatus of claim 6, wherein the rounded cutout comprises a semi-circle cutout extending from a top edge, and further comprising a tubular label roll holder configured to extend through the roll of labels, wherein each of opposing ends of the label roll holder sets in one of the rounded cutouts.

8. The apparatus of claim 6, wherein each of opposing lid side walls, extending perpendicular from the top portion, includes a rounded cutout adapted to receive the label roll holder.

9. The apparatus of claim 1, further comprising:

a raisable tab defined within the bottom panel; and an open or openable slot cut within the top panel, wherein the raisable tab is sized to fit within the slot to secure the bottom portion in a stacked position upon the lid.

10. The apparatus of claim 9, wherein the raisable tab is cut in the bottom portion along a portion of the periphery, and has a fold line connecting ends of the cut and at an edge intersection of the bottom panel and one of the four bottom side walls.

11. An apparatus for holding and dispensing labels, the apparatus comprising:

a bottom portion including a bottom panel, four bottom side walls, and an open top, wherein the bottom panel and four bottom side walls enclose a container space configured to hold a plurality of labels, wherein the plurality of labels are embodied as a stack of fanfold labels or a roll of labels;

a lid configured to fit over the bottom section and cover the open top, the lid including a top panel, four lid side walls, and an open bottom configured to receive the bottom portion; and a first side wall of the four bottom side walls including: a fold line extending parallel to the bottom panel; and two cuts extending from the fold line towards the open top, wherein a detachable section is formed between the two cuts and foldable about the fold line to open a feed opening in the first side wall and allow a feed of the plurality of labels to a printer through the feed opening.

12. The apparatus of claim 11, further comprising a breakable material bridge between each of the cuts and the open top.

13. The apparatus of claim 11, wherein each of the cuts is at a corner intersection of the first bottom side wall and an adjacent bottom side wall.

14. The apparatus of claim 11, wherein each of a second bottom side wall of the four bottom side walls and a third bottom side wall of the four bottom side walls extends perpendicular to the first bottom side wall, the second bottom side wall connected to the bottom panel on an opposite side of the container space from the third bottom side wall, and each of the second and third bottom side walls including a rounded cutout adapted to receive a label roll holder.

15. The apparatus of claim 14, wherein the rounded cutout comprises a semi-circle cutout extending from a top edge, and further comprising a tubular label roll holder configured to extend through the roll of labels, where each of opposing holder ends sets in one of the rounded cutouts.

16. The apparatus of claim 14, wherein each of a pair of opposing lid side walls, each extending perpendicular from the top portion, includes a rounded cutout adapted to receive the label roll holder.

17. The apparatus of claim 11, further comprising:

a raisable tab defined within the bottom panel, wherein the raisable tab is cut on three sides and has a fold line at an edge intersection of the bottom panel and one of the four bottom side walls; and an open or openable slot cut within the top panel, wherein the raisable tab is sized to fit within the slot to secure the bottom portion in a stacked position upon the lid.

18. A method of using the apparatus of claim 11, the method comprising:

removing the lid from the bottom portion to expose the plurality of labels;

folding the detachable section at an angle to a remaining portion of the first side wall to expose the feed opening; and feeding the labels through the feed opening to the printer.

19. A method of using the apparatus of claim 14, the method comprising:

removing the lid from the bottom portion to expose the plurality of labels;

folding the detachable section at an angle to a remaining portion of the first side wall to expose the feed opening;

placing a label roll holder through the roll of labels;

setting ends of the label roll holder that extend past opposing sides of the roll of labels within the rounded cutouts of the second and third bottom side walls; and feeding the labels through the feed opening to the printer.

20. A method of using the apparatus of claim 17, the method comprising:

removing the lid from the bottom portion to expose the plurality of labels;

folding the detachable section at an angle to a remaining portion of the first side wall to expose the feed opening;

raising the raisable tabs outward from the bottom panel;

placing the lid on a surface with the open bottom on the surface;

aligning the raised tab with the open slot of the top panel;

stacking the bottom portion on the lid with the raised tab within the open slot; and feeding the labels through the feed opening to the printer.

* * * * *